US008634564B2

(12) United States Patent
Sakai

(10) Patent No.: US 8,634,564 B2
(45) Date of Patent: Jan. 21, 2014

(54) SIGNAL PROCESSING DEVICE AND METHOD, AND A PROGRAM

(75) Inventor: Kazuki Sakai, Tokyo (JP)

(73) Assignee: Sony Corporation, Tokyo (JP)

( * ) Notice: Subject to any disclaimer, the term of this patent is extended or adjusted under 35 U.S.C. 154(b) by 398 days.

(21) Appl. No.: 13/039,716

(22) Filed: Mar. 3, 2011

(65) Prior Publication Data

US 2011/0243335 A1 Oct. 6, 2011

(30) Foreign Application Priority Data

Mar. 31, 2010 (JP) ..... P2010-083599

(51) Int. Cl.
*H04R 5/00* (2006.01)

(52) U.S. Cl.
USPC ..... 381/17; 381/300; 381/303; 381/304; 381/305; 381/56; 381/58; 381/59; 381/96; 381/97; 381/98

(58) Field of Classification Search
USPC ..... 381/17, 303, 56, 58, 59, 96, 97, 98, 381/300, 304, 305
See application file for complete search history.

(56) References Cited

U.S. PATENT DOCUMENTS

2004/0202332 A1 * 10/2004 Murohashi et al. ..... 381/17

FOREIGN PATENT DOCUMENTS

JP 2005-94072 4/2005

* cited by examiner

*Primary Examiner* — Vivian Chin
*Assistant Examiner* — Paul Kim
(74) *Attorney, Agent, or Firm* — Finnegan, Henderson, Farabow, Garrett & Dunner, L.L.P.

(57) ABSTRACT

A signal processing device includes: a sound adjustment amount calculation unit which calculates a sound adjustment amount for adjusting sound characteristics of each channel to a predetermined sound characteristic for each channel, using a sound signal that is obtained by collecting the outputs of each channel; an evaluation value calculation unit which calculates a coefficient allocation evaluation value for allocating a size of a filter coefficient necessary for the sound adjustment of the respective channels for each channel, based on the sound adjustment amount that is calculated by the sound adjustment amount calculation unit; and a filter coefficient calculation unit which calculates the filter coefficient for each channel using the coefficient allocation evaluation value that is calculated by the evaluation value calculation unit.

10 Claims, 15 Drawing Sheets

FIG. 17

| CHANNEL | MOVIE | MUSIC | GAME |
|---|---|---|---|
| FRONT L/R | 0.3 | 0.4 | 0.24 |
| CENTER | 0.2 | 0.1 | 0.24 |
| SURROUND L/R | 0.1 | 0.1 | 0.24 |

SIGNAL PROCESSING DEVICE AND METHOD, AND A PROGRAM

BACKGROUND OF THE INVENTION

1. Field of the Invention

The present invention relates to a signal processing device and method, and a program, and particularly to a signal processing device and method, and a program that can perform effective and efficient sound adjustment under limited calculation resources.

2. Description of the Related Art

In order to accurately reproduce a surround effect by a multi channel audio signal, there is a necessity to suitably regulate a value of a sound characteristic parameter relating to a frequency characteristic or the like of audio signals to be output from each speaker.

There is a sound adjustment device which includes an automatic sound characteristic regulation function capable of automatically regulating the value of the parameter. This sound adjustment device outputs test signals such as noise or an impulse signal from the respective speakers in advance, collects and records the output signals from the respective speakers by a microphone placed in a listening position. Moreover, the frequency characteristics or the like of the recorded signals are interpreted and the respective filter coefficients are calculated so as to match the preset frequency characteristic or the like.

At the time of the audio signal playback, the filters are applied to the respective channel signals, and the sounds corresponding to the applied signals are output from the respective speakers. Although the channel number, to which the filter is applied, is basically 5ch except for a low zone dedicated channel, the channel number may be 7ch or 9ch in some cases.

In addition, as another technology relating to the sound playback, a technique is also suggested which adjusts the sound quality of the output content corresponding to the information on the content (JP-A-2005-94072 is an example of related art.).

SUMMARY OF THE INVENTION

However, in the aforementioned sound adjustment device of the related art, a filter having a preset coefficient size is user for the respective channel signals. Thus, corresponding to a combination of the characteristics of the connected speakers or the frequency characteristics to be set as an objective in advance, an excess or deficiency is generated in the sound adjustment amount, resulting in inefficiency.

Furthermore, when the adjustment of a frequency amplitude characteristic and a frequency phase characteristic is performed, an FIR filter is used. Since the FIR filter defines a lower limit of the adjustable frequency, a larger coefficient size is necessary for the coefficient size of the FIR filter in order to enable the frequency characteristic of a lower zone to be corrected. The FIR filter has a calculation load higher than an IIR filter, and the calculation load is also heightened in proportion to a height of a sampling frequency of an audio signal and a channel number of the audio signal.

Thus, it is obviously difficult to apply the FIR filter having a sufficient size to numerous channels under the limited calculation resources, and particularly, it is difficult to sufficiently perform the adjustment of the sound characteristic of a low zone.

It is desirable to enable an efficient and effective sound adjustment to perform under limited calculation resources.

A signal processing device according to an embodiment of the invention includes sound adjustment amount calculation means which calculates a sound adjustment amount for adjusting sound characteristics of each channel to a predetermined sound characteristic for each channel, using a sound signal that is obtained by collecting the outputs of each channel; evaluation value calculation means which calculates a coefficient allocation evaluation value for allocating a size of a filter coefficient necessary for the sound adjustment of the respective channels for each channel, based on the sound adjustment amount that is calculated by the sound adjustment amount calculation unit; and a filter coefficient calculation means which calculates the filter coefficient for each channel using the coefficient allocation evaluation value that is calculated by the evaluation value calculation unit.

The evaluation value calculation means can calculate the coefficient allocation evaluation value for each channel by multiplying the calculated coefficient allocation evaluation value by a weighting value corresponding to the content becoming a playback target.

The weighting value corresponding to the content is set for each channel corresponding to the content in advance.

The signal processing device according to the embodiment of the invention further includes a frequency interpretation means which interprets the playback frequency of the respective channels at the time of the playback of the content, and the weighting value corresponding to the content is calculated for each channel on the basis of the playback frequency that is interpreted by the frequency interpretation unit.

In the case of being determined as a small speaker from a ratio of an area of a low zone and a high zone of the sound signal, the sound adjustment amount calculation means can calculate the sound adjustment amount for each channel by multiplying the calculated sound adjustment amount by a weighting coefficient in which the low zone is limited.

The signal processing device according to the embodiment of the invention can further include a filter processing means which performs the filter processing of the sound signal of the contents during playback for each channel using the filter coefficient calculated by the filter coefficient calculation unit, and a delay means which performs the delay processing of the sound signal subjected to the filter processing by the filter processing means for each channel.

The channels include five channels or more.

According to another embodiment of the invention, there is provided a signal processing method of a signal processing device including a sound adjustment amount calculation unit, an evaluation value calculation unit, and a filter coefficient calculation unit, wherein the sound adjustment amount calculation means calculates a sound adjustment amount for adjusting sound characteristics of each channel to a predetermined sound characteristic for each channel, using a sound signal that is obtained by collecting the outputs of each channel, wherein the evaluation value calculation means calculates a coefficient allocation evaluation value for allocating a size of a filter coefficient necessary for the sound adjustment of the respective channels for each channel, based on the calculated sound adjustment amount, and wherein the filter coefficient calculation means calculates the filter coefficient for each channel using the calculated coefficient allocation evaluation value.

A program according to still another embodiment of the invention causes a computer to function as a sound adjustment amount calculation means which calculates a sound adjustment amount for adjusting sound characteristics of each channel to a predetermined sound characteristic for each channel, using a sound signal that is obtained by collecting the outputs of each channel; an evaluation value calculation means which calculates a coefficient allocation evaluation value for allocating a size of a filter coefficient necessary for the sound adjustment of the respective channels for each channel, based on the sound adjustment amount that is calculated by the sound adjustment amount calculation unit; and a filter coefficient calculation means which calculates the filter coefficient for each channel using the coefficient allocation evaluation value that is calculated by the evaluation value calculation unit.

In an embodiment of the invention, a sound adjustment amount for adjusting the sound characteristics of the respective channels to a predetermined sound characteristic is calculated for each channel using a sound signal that is obtained by collecting the outputs of each channel, and a coefficient allocation evaluation value for allocating the size of a filter coefficient necessary for the sound adjustment of the respective channels is calculated for each channel based on the calculated sound adjustment amount. Moreover, the filter coefficient is calculated for each channel using the calculated coefficient allocation evaluation value.

In addition, the signal processing device may be an independent device or an inner block that forms one signal processing device.

According to another embodiment of the invention, it is possible to perform an effective and efficient sound adjustment under limited calculation resources.

BRIEF DESCRIPTION OF THE DRAWINGS

FIG. 17 is a diagram showing an example of a weighting value corresponding to the contents of a playback content;

DESCRIPTION OF THE PREFERRED EMBODIMENTS

Hereinafter, an embodiment of the invention will be described with reference to the drawings.

Configuration Example of Signal Processing Device

Figure 1:
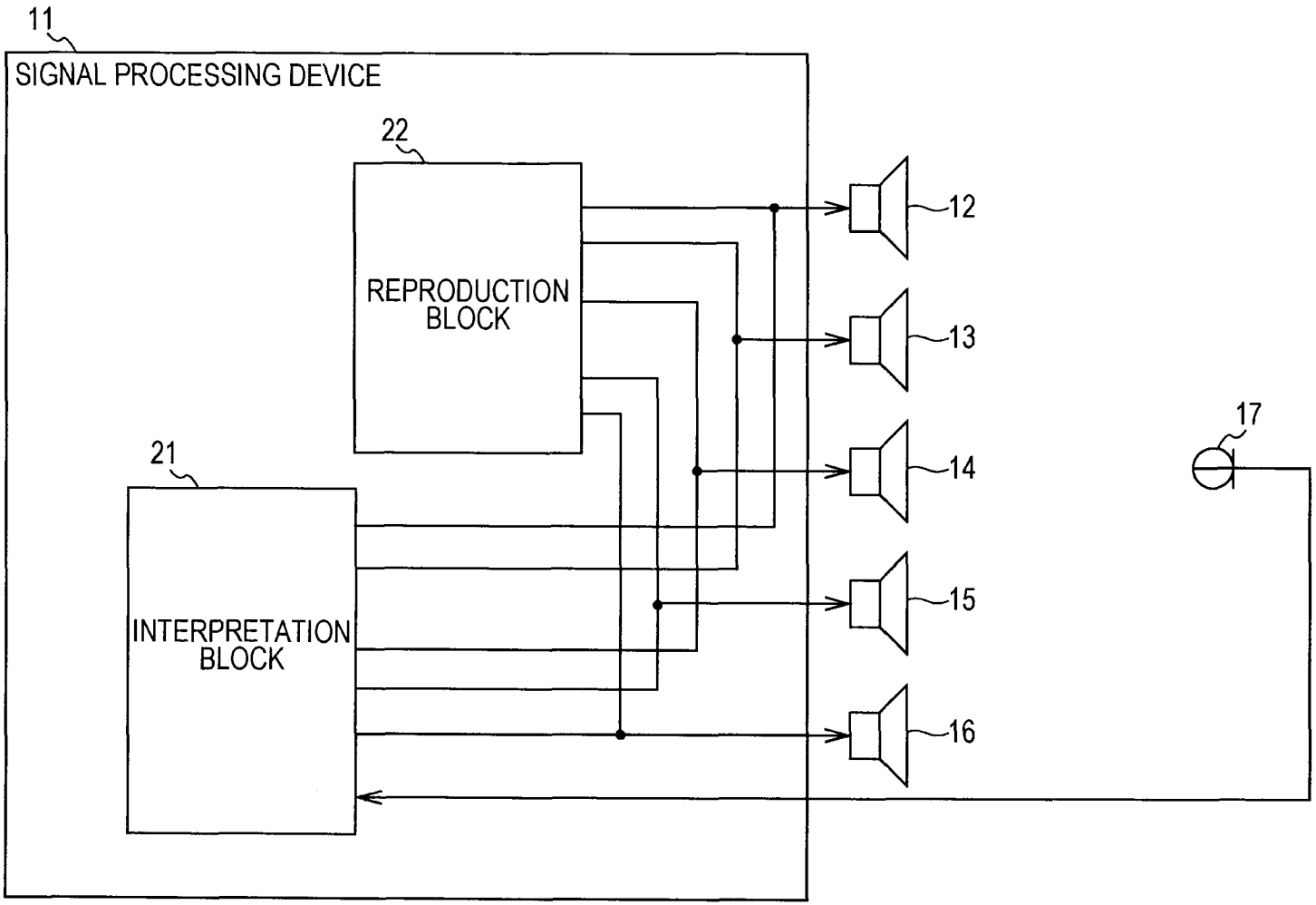
FIG. 1 is a block diagram showing a configuration of an embodiment of a signal processing device to which the invention is applied.

FIG. 1 shows a configuration of a first embodiment of a signal processing device to which the invention is applied. A signal processing device 11 performs an interpretation of sound characteristics from the respective speakers 12 to 16 of 5ch except for a low zone dedicated channel of 5.1 ch (channel). Moreover, the signal processing device 11 outputs the signal of the content from an external signal source as the sound from the respective speakers 12 to 16 of 5.1ch using the interpretation results.

A center speaker 12, a front L (left) speaker 13, a front R (right) speaker 14, a surround L speaker 15, a surround R speaker 16, and a microphone 17 are connected to the signal processing device 11 of FIG. 1.

The center speaker 12 outputs the sound of the center channel among the 5.1ch. The front L speaker 13 outputs the sound of the front L channel among the 5.1ch. The front R speaker 14 outputs the sound of the front R channel among the 5.1ch. The surround L speaker 15 outputs the sound of the surround L channel among the 5.1ch. The surround R speaker 16 outputs the sound of the surround R channel among the 5.1ch. The microphone 17 is installed in front of the center speaker 12 to collect the sound from the respective speakers. In addition, in the example of FIG. 1, a speaker of a low zone dedicated channel is omitted.

The signal processing device 11 includes an interpretation block 21 and a playback block 22. The interpretation block 21 collects the sounds from the respective speakers 12 to 16 by the microphone 17, interprets the sound characteristics from the respective speakers 12 to 16 which are connected from the respective speakers 12 to 16, and calculates the filter coefficient for matching with the sound characteristic set as an object in advance.

The playback block 22 applies the filter processing by the filter coefficient calculated by the interpretation block 21 to the output signals to the respective speakers 12 to 16, and provides a user with a correct surround effect at the time of a multi channel (5.1ch) audio signal playback by giving a suitable time delay.

Configuration Example of Interpretation Block

Figure 2:
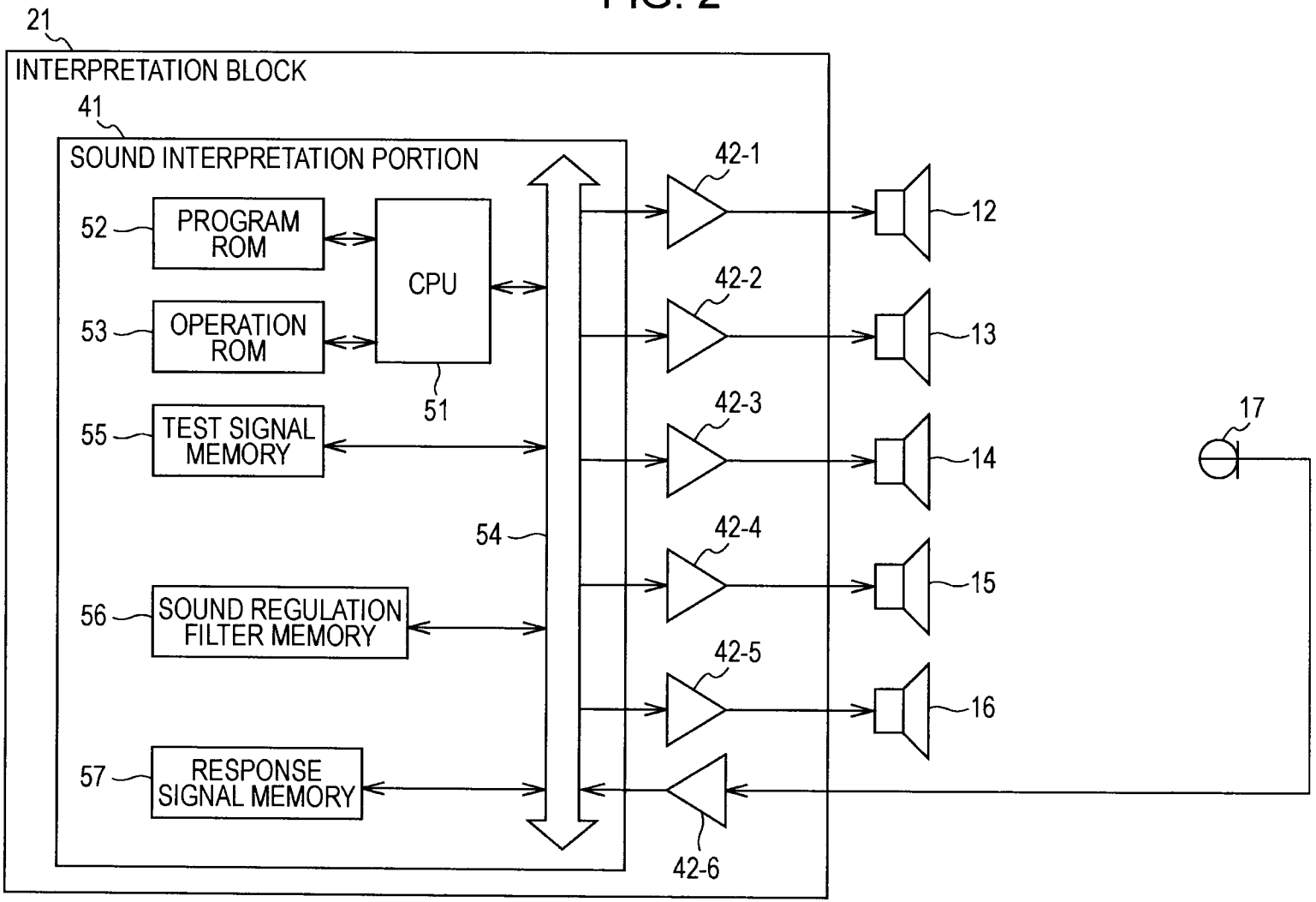
FIG. 2 is a block diagram showing a configuration example of an interpretation block.

FIG. 2 is a block diagram that shows a configuration example of the interpretation block of FIG. 1.

The interpretation block 21 of the example of FIG. 2 is configured so as to include a sound interpretation portion 41 and amplifiers 42-1 to 42-6.

The sound interpretation portion 41 includes a CPU (Central Processing Unit) 51, a program ROM (Read Only Memory) 52, an operation RAM (Random Access Memory) 53, an internal bus 54, a test signal memory 55, a sound adjustment filter memory 56, and a response signal memory 57. The CPU 51, the test signal memory 55, the sound adjustment filter memory 56, and the response signal memory 57 are connected to each other via an internal bus 54.

The CPU 51 performs the sound interpretation processing by loading and carrying out a sound interpretation program, which is read from the program ROM 52, to the operation RAM 53. At that time, the CPU 51 reads the test signals stored in the test signal memory 55 one by one, outputs the sounds from the respective speakers, and records the collected response signals from the respective speakers in the response signal memory 57. The CPU 51 calculates the suitable filter coefficients for the respective speakers based on the response signals, and records the calculated filter coefficients in the sound adjustment filter memory 56.

The test signal memory 55 stores the sound adjustment test signals, sequentially reads the signals at the time of the sound adjustment, and outputs the read test signals to the respective speakers 12 to 16 via the internal bus 54 and the corresponding amplifiers 42-1 to 42-5.

The sound adjustment filter memory 56 stores a combination of the filter coefficients that is optimal for the respective speakers 12 to 16 calculated by the CPU 51. The combination of the filter coefficients is read and used at the time of the playback processing.

The response signal memory 57 sequentially records the response signals that are collected by the microphone 17. The response signals are read by the CPU 51 via the internal bus 54 and are used in the sound adjustment processing.

The amplifier 42-1 amplifies the test signal from the test signal memory 55 to be input via the internal bus 54, and outputs the same to the center speaker 12. The amplifier 42-2 amplifies the test signal from the test signal memory 55 to be input via the internal bus 54, and outputs the same to the front L speaker 13. The amplifier 42-3 amplifies the test signal from the test signal memory 55 to be input via the internal bus 54, and outputs the same to the front R speaker 14. The amplifier 42-4 amplifies the test signal from the test signal memory 55 to be input via the internal bus 54, and outputs the same to the surround L speaker 15. The amplifier 42-5 amplifies the test signal from the test signal memory 55 to be input via the internal bus 54, and outputs the same to the surround R speaker 16.

The amplifier 42-6 amplifies the response signal collected by the microphone 17 and outputs the same to the response signal memory 57 via the internal bus 54.

Configuration Example of a Sound Interpretation Functional Block

Figure 3:
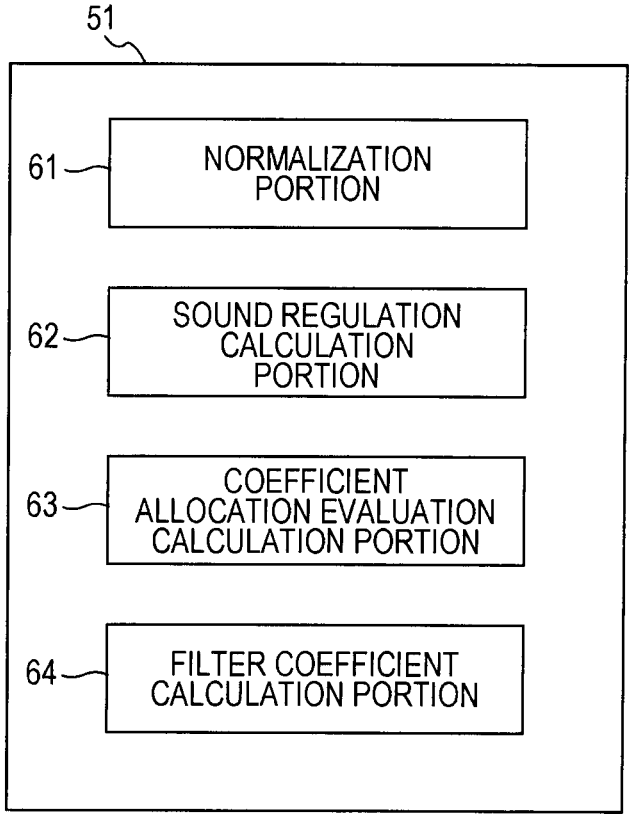
FIG. 3 is a block diagram showing a functional configuration example of an interpretation block.

FIG. 3 is a block diagram that shows a configuration example of a sound interpretation functional block which is carried out by being developed to the operation RAM 53 by the CPU 51.

In an example of FIG. 3, the sound interpretation functional block includes a normalization portion 61, a sound adjustment amount calculation portion 62, a coefficient allocation evaluation value calculation portion 63, and a filer coefficient calculation portion 64.

The normalization portion 61 planarizes a frequency amplitude characteristic which is obtained by converting the response signal read from the response signal memory 57 to the frequency axis, thereby calculating an average amplitude value in a medium low zone. The normalization portion 61 obtains the value in which the calculated average amplitude value becomes identical to the average amplitude value in the medium low zone of the frequency amplitude characteristic set as an object in advance, and multiplies the value by all the planarized frequency amplitude characteristics, thereby carrying out the gain adjustment.

The sound adjustment amount calculation portion 62 calculates the respective sound adjustment amount for matching the frequency amplitude characteristic (that is, the sound characteristic) obtained by the normalization portion 61 to objective frequency amplitude characteristic, and then multiplies the weighting coefficient by the respective sound adjustment amounts to calculate a new sound adjustment amount. Furthermore, the sound adjustment amount calculation portion 62 performs the weighting corresponding to the low zone playback abilities of the respective connected speakers.

The coefficient allocation evaluation value calculation portion 63 calculates the coefficient allocation evaluation value based on the sound adjustment amount calculated by the sound adjustment amount calculation portion 62. The coefficient allocation evaluation value is an evaluation value for allocating the size of the filter coefficient necessary for the sound adjustment of the respective channels. Furthermore, the coefficient allocation evaluation value calculation portion 63 performs the weighting corresponding to the content with respect to the coefficient allocation evaluation value.

The filter coefficient calculation portion 64 calculates the filter coefficients of the respective channels (that is, the respective speakers 12 to 16) based on the coefficient allocation evaluation value calculated by the coefficient allocation evaluation value calculation portion 63. The filter coefficient calculation portion 64 stores the combination of the calculated filter coefficients in the sound adjustment filter memory 56.

Description of Interpretation Processing

Next, the interpretation processing of the interpretation block 21 of FIG. 1 will be described with reference to a flow chart of FIG. 4.

In step S11, the CPU 51 sequentially reads the test signals stored in the test signal memory 55, and, for example, outputs the test signals from the center speaker 12 via the internal bus 54.

In step S12, the CPU 51 sequentially records the response signals collected from the center speaker in the response signal memory 57. In addition, the processing of the steps S11 and S12 is also performed with respect to the other respective speakers 13 to 16. Furthermore, in the subsequent steps, the response signals of the respective channel are used and the signal processing is performed for each channel.

In step S13, the normalization portion 61 normalizes the respective response signals recorded in the response signal memory 57. That is, the normalization portion 61 converts an ACK response signal read from the response signal memory 57 into a frequency axis by the FFT, thereby obtaining the frequency amplitude characteristic.

Figure 5:
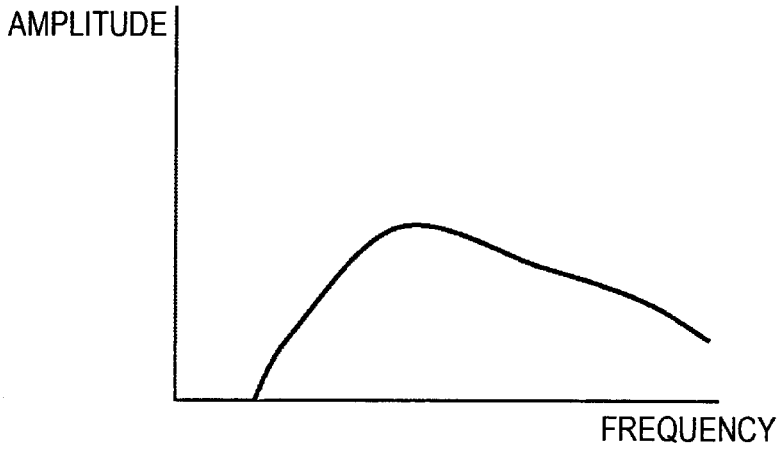
FIG. 5 is a diagram showing an example of a frequency amplitude characteristic.

FIG. 5 shows a graph that displays the frequency amplitude characteristic. A horizontal axis of the frequency amplitude characteristic indicates an ogarithm frequency axis and a longitudinal axis thereof indicates an amplitude level. The normalization portion 61 planarizes the frequency amplitude characteristic and calculates an average amplitude value in a medium low zone. For example, in the program ROM 52, an objective frequency amplitude characteristic shown in FIG. 6 and the average amplitude value in the medium low zone are stored. In addition, as the range of the medium low zone, for example, 250 Hz to 8 kHz is set.

Figure 6:
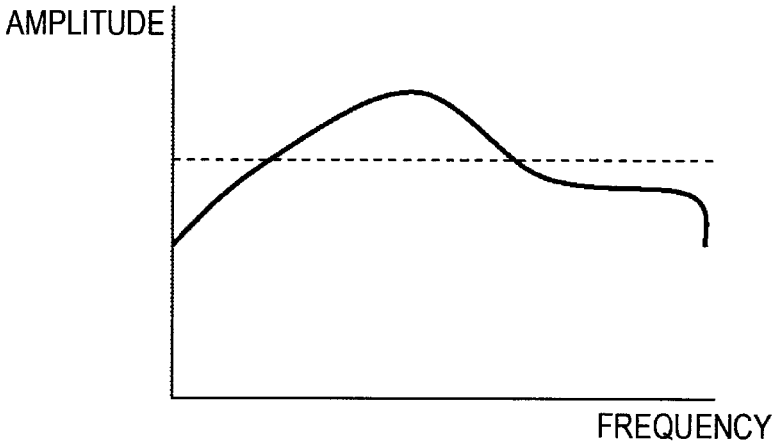
FIG. 6 is a diagram showing an example of an objective frequency amplitude characteristic.
Figure 7:
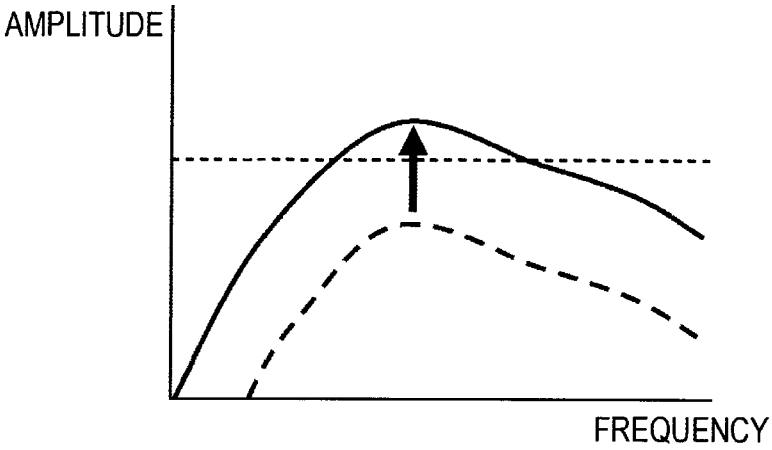
FIG. 7 is a diagram that describes a gain adjustment in respect to the frequency amplitude characteristic of FIG. 5.

The normalization portion 61 obtains the value in which the average amplitude value in the medium low zone of the frequency amplitude characteristic of FIG. 5 becomes identical to the average amplitude value in the medium zone of the objective frequency amplitude characteristic of FIG. 6. Moreover, the normalization portion 61 performs the gain adjustment as shown in FIG. 7 by multiplying the value by the whole of the planarized frequency amplitude characteristics. In the example shown in FIG. 7, the gain adjustment to the large amplitude level is adjusted so that the frequency amplitude characteristic of FIG. 5 shown by the dotted lines is matched to the frequency amplitude characteristic of FIG. 6. The frequency amplitude characteristic subjected to the gain adjustment is supplied to the sound adjustment amount calculation portion 62.

Figure 8:
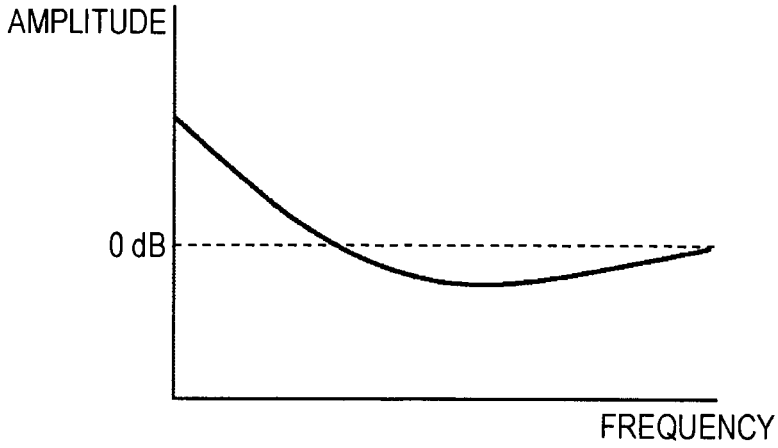
FIG. 8 is a diagram showing an example of a sound adjustment amount.

In step S14, the sound adjustment amount calculation portion 62 calculates the respective sound adjustment amounts for matching the frequency amplitude characteristic obtained by the normalization portion 61 to a preset objective frequency amplitude characteristic. That is, the sound adjustment amount calculation portion 62 obtains the sound adjustment amount as shown in FIG. 8 by subtracting the frequency amplitude characteristic obtained by the normalization portion 61 from the objective frequency characteristic.

Figure 9:
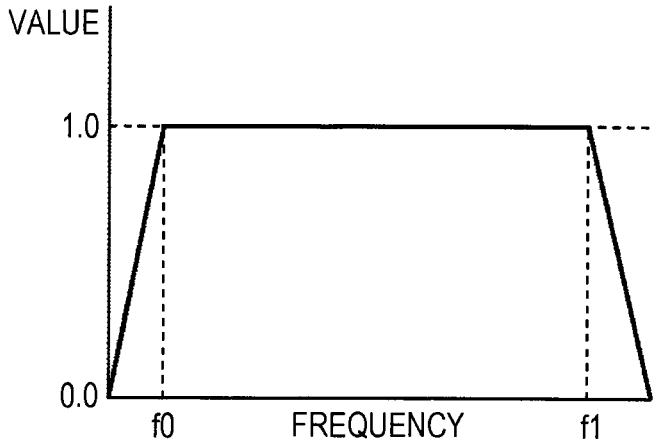
FIG. 9 is a diagram showing an example of a weighting coefficient.
Figure 10:
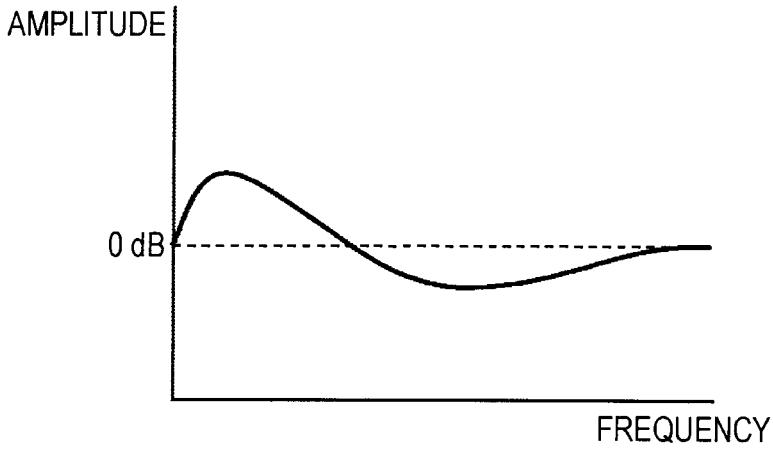
FIG. 10 is a diagram showing an example of a sound adjustment amount.

Moreover, the sound adjustment amount calculation portion 62 multiplies the weighting coefficient as shown in FIG. 9 by the obtained respective sound adjustment amounts. For example, as shown in FIG. 9, the weighting coefficient is multiplied by a weighting coefficient which gradually becomes 0.0 from any given frequency f0 of the low zone side over a minimum frequency and gradually becomes 1.0 from any given frequency f1 of the high zone side over the maximum frequency. For example, an example of F0 is 60 Hz to 80 Hz, and an example of f1 is 12 kHz to 16 kHz. As a consequence, the sound adjustment amount calculation portion 62 obtains a new sound adjustment amount shown in FIG. 10.

In this manner, by gradually setting the adjustment amounts of the low zone side and the high zone side to 0, the sound adjustment amounts to the low zone end and the high zone end are limited. As a result, the sound adjustment at a more important band in an auditory sense of other people is considered importantly.

Figure 11:
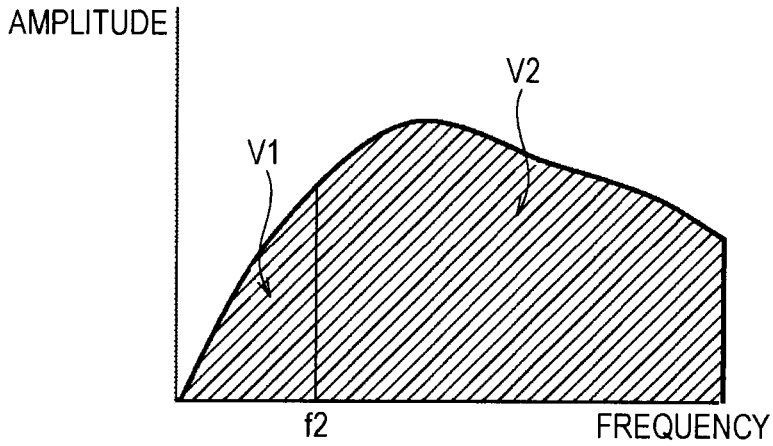
FIG. 11 is a diagram that explains a decision method of a small speaker.

Next, in step S15, the sound adjustment amount calculation portion 62 determines whether or not a speaker becoming the interpretation target is a small speaker. That is, in steps S15 and S16, the weighting corresponding to the low zone playback abilities of the respective connected speakers is performed. Firstly, the sound adjustment amount calculation portion 62 performs the decision of the low zone playback ability of the speaker from the frequency amplitude characteristic. An index value R for performing the decision can be obtained as follows:

As shown in FIG. 11, by setting the frequency f2 in the frequency amplitude characteristic as a boundary, an area V1 of the low zone of the frequency f2 or less and an area V2 of the high zone of the frequency f2 or more are calculated. Moreover, as shown in the following equation (1), the sound adjustment amount calculation portion 62 sets the ratio of the area V1+V2 occupying the whole and the area V1 occupying the low zone of the frequency f2 or less as the index value R.

$$R=V1/(V1+V2) \quad (1)$$

When the index value R is equal to or less than a certain threshold value x, the speaker is determined as a speaker which lacks in the playback ability of the low zone, that is, a small speaker. When the index value x is greater than the threshold value x, the speaker is determined as a speaker which has a sufficiently high playback ability of the low zone, that is a medium-large speaker. The frequency f2 is, for example, 120 Hz, and the threshold value x is, for example, 0.1 to 0.2.

Figure 12:
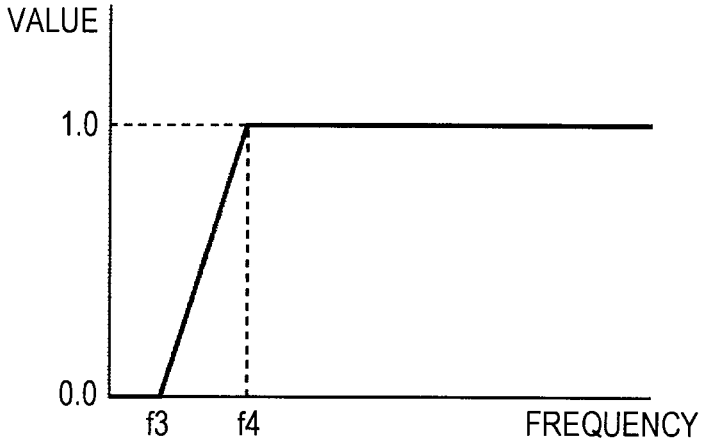
FIG. 12 is a diagram showing an example of a weighting coefficient relative to a small speaker.
Figure 13:
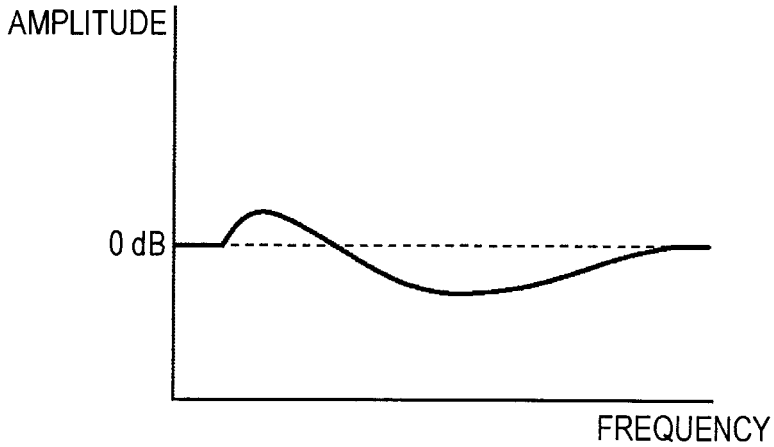
FIG. 13 is a diagram showing an example of a sound adjustment amount.

In step S15, if the speaker is determined as the small speaker, the sound adjustment amount calculation portion 62 multiplies the obtained sound adjustment amount by the weighting coefficient in which the limitation is applied to the low zone shown in FIG. 12 in step S16, thereby setting as a new sound adjustment amount (FIG. 13).

For example, in step S16, as shown in FIG. 12, a weighting coefficient is multiplied which is 0.0 from the minimum frequency to a certain frequency f3 of the low zone side and gradually becomes 1.0 from the frequency f3 to a certain frequency f4 of the low zone side greater than the frequency f3. For example, an example of the frequency f3 is 60 Hz, and an example of the frequency f4 is 250 Hz.

That is, originally, since the small speaker hardly outputs the low zone, the weighting of the low zone becomes 0. As a result, it is possible to allocate the size of the filter coefficient to the necessary for sound range or the sound signal.

Meanwhile, in step S15, if the speaker is not determined as a small speaker but a medium-large speaker, the step S16 is skipped and the processing progresses to step S17. That is, the weighting is not performed in the channel determined as the medium-large speaker.

FIG. 13 indicates a sound adjustment amount of the result multiplied by the weighting coefficient shown in FIG. 12. By being multiplied by the weighting coefficient, in the case of the small speaker, the amplitude level of the low zone becomes constant as 0 dB. The sound adjustment amount obtained by the sound adjustment amount calculation portion 62 is supplied to the coefficient allocation evaluation value calculation portion 63.

Figure 14:
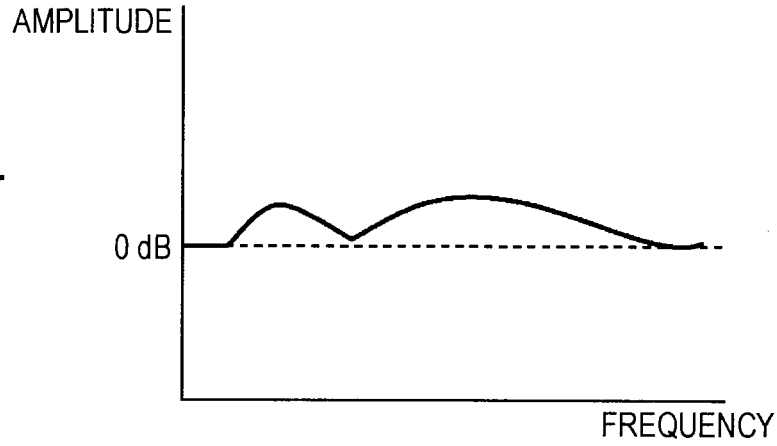
FIG. 14 is a diagram that explains an absolute value of an amplitude characteristic of a sound adjustment amount.

In step S17, the coefficient allocation evaluation value calculation portion 63 calculates the coefficient allocation evaluation value based on the sound adjustment amount calculated by the sound adjustment amount calculation portion 62. That is, as shown in FIG. 14, the coefficient allocation evaluation value calculation portion 63 takes an absolute value of the amplitude characteristic with respect to the sound adjustment amount calculated by the sound adjustment amount calculation portion 62. Moreover, the coefficient allocation evaluation value calculation portion 63 multiplies the absolute value of the amplitude characteristic by the weighting coefficient shown in FIG. 15 which reduces the high zone, thereby calculating a total (a diagonal line of FIG. 16) of a portion of an area of 0 dB or more.

Figure 15:
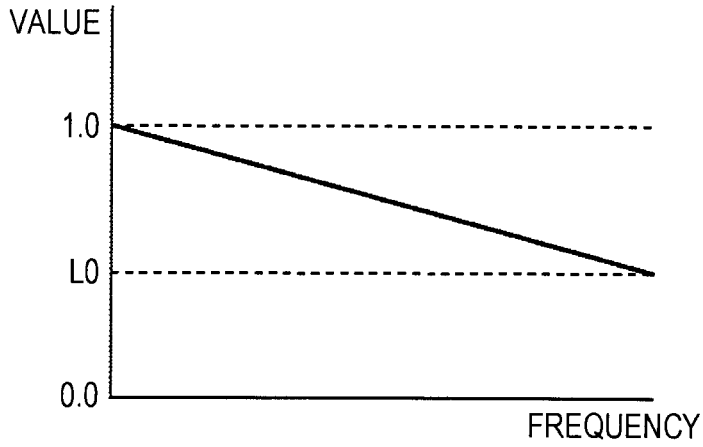
FIG. 15 is a diagram showing an example of a weighting coefficient.

In an example of FIG. 15, since the length of the filter greatly depends on the sound adjustment amount of the low zone more than on the high zone, the weighting coefficient is multiplied in which 1.0 gradually becomes L0 from the frequency of the low zone to the frequency of the high zone. Herein, L0 is set, for example, as 0.4 to 0.6.

Figure 16:
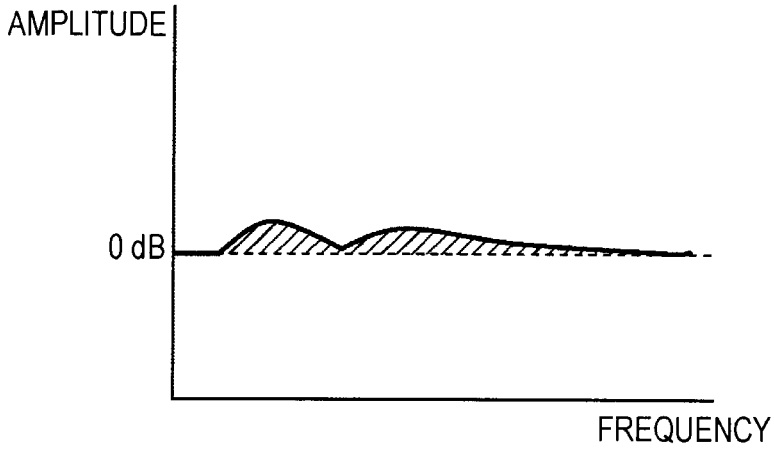
FIG. 16 is a diagram showing an example of a coefficient allocation evaluation value.

As a result, the coefficient allocation evaluation value is calculated which is the diagonal line portion in FIG. 16. In the example of FIG. 16, the diagonal line portion indicates the coefficient allocation evaluation value. The larger the area of the coefficient allocation evaluation value (the diagonal line portion) is, the longer the length of the filter can be allocated, and the smaller the area is, the shorter the length of the filter can be allocated.

Moreover, the coefficient allocation evaluation value calculation portion 63 performs the weighting corresponding to the content to the calculated coefficient allocation evaluation value in step S18. For example, the combination of the weighting values corresponding to the genre of the content is stored in the program ROM 52 (or the sound adjustment filter memory 56) or the like. The coefficient allocation evaluation value calculation portion 63 multiplies the weighting value corresponding to the genre of the reproduced content and sets the multiplication result as the coefficient allocation evaluation value of the target channel. The coefficient allocation evaluation value of the target channel is supplied to the filter coefficient calculation portion 64.

FIG. 17 shows the weighting value corresponding to the content of the playback content. For example, in a case where a genre of the content is movies, with respect to the coefficient allocation evaluation value, at the time of the front L/R channel, the weighting value of 0.3 is multiplied, at the time of the center channel, the weighting value of 0.2 is multiplied, and in regard to the surround L/R channel, the weighting value of 0.1 is multiplied.

Furthermore, in a case where a genre of the content is music, with respect to the coefficient allocation evaluation value, at the time of the front L/R channel, the weighting value of 0.4 is multiplied, at the time of the center channel, the weighting value of 0.1 is multiplied, and in regard to the surround L/R channel, the weighting value of 0.1 is multiplied.

Moreover, in a case where a genre of the content is games, with respect to the coefficient allocation evaluation value, at the time of the front L/R channel, the weighting value of 0.24 is multiplied, at the time of the center channel, the weighting value of 0.24 is multiplied, and in regard to the surround L/R channel, the weighting value of 0.24 is multiplied.

That is, the playback frequencies of the respective channels of the multi-channel audio are not identical to each other, but mainly depend on the genre of the reproduced content in many cases. For example, in the music content, there is a tendency that the playback frequency of the front L/R channel is high and the sound quality of the channel is most emphasized. In the movies content, in addition to the front L/R channel, the frequency of the center channel reproducing the dialogue is also heightened, and the sound quality of the center channel is also emphasized. On the other hand, in the games content, there is a tendency that all the channels are equally reproduced.

In view of this circumstance, by not equally handling the coefficient allocation to the respective channels (the speakers) but performing the weighting corresponding to the genre of the playback content, it is possible to allocate many more filter coefficients to the channel which has the high playback frequency, that is, the channel which becomes important.

In step S19, the filter coefficient calculation portion 64 calculates the filter coefficients of the respective channels based on the coefficient allocation evaluation value that is calculated by the coefficient allocation evaluation value calculation portion 63. Firstly, the filter coefficient calculation portion 64 sets the filter coefficient sizes of the respective channels based on the calculated coefficient allocation evaluation value. For example, a filter coefficient size Li of a channel i is defined by the following equation (2):

$$Li=K*Pi/T \quad (2)$$

Herein, T is a sum value of the coefficient allocation evaluation values of the respective calculated channels. K is a value in which the coefficient sizes of the FIR filter capable of performing the calculation processing in the signal processing device 11 of FIG. 1 are added over all the channels. Pi is a calculated coefficient allocation evaluation value in the channel i.

The coefficients of the respective filters are calculated by the filter coefficient size Li defined as the equation (2) and the coefficient allocation evaluation value obtained in the step S18. As a method of calculating the filter coefficient, for example, it is possible to use a design method which uses a general FFT and a window function, or a filter design method by Remez.

In addition, sine the coefficient allocation size differs corresponding to the genre of the playback content, it is possible to obtain the combination of a plurality of filter coefficients corresponding to the genre of the playback content.

The filter coefficient calculation portion 64 stores the combination of the obtained filter coefficients in the sound adjustment filter memory 56 in step S20.

As mentioned above, within the coefficient size of the FIR filter of all the channels capable of performing the calculation processing in the signal processing device 11, the FIR filter coefficient optimal for the respective channel is obtained.

As a result, an effective and efficient sound adjustment under the limited calculation resources is possible, and thus a suitable surround effect can be obtained.

Furthermore, since the weighting corresponding to the playback content is performed, it is possible to allocate many more filter coefficients to the channel which has a high playback frequency, that is, the channel which becomes important, under the limited calculation resources.

As a result, the sound adjustment optimal for the playback content is possible, and thus a suitable surround effect can be obtained.

Configuration Example of Playback Block

Figure 18:
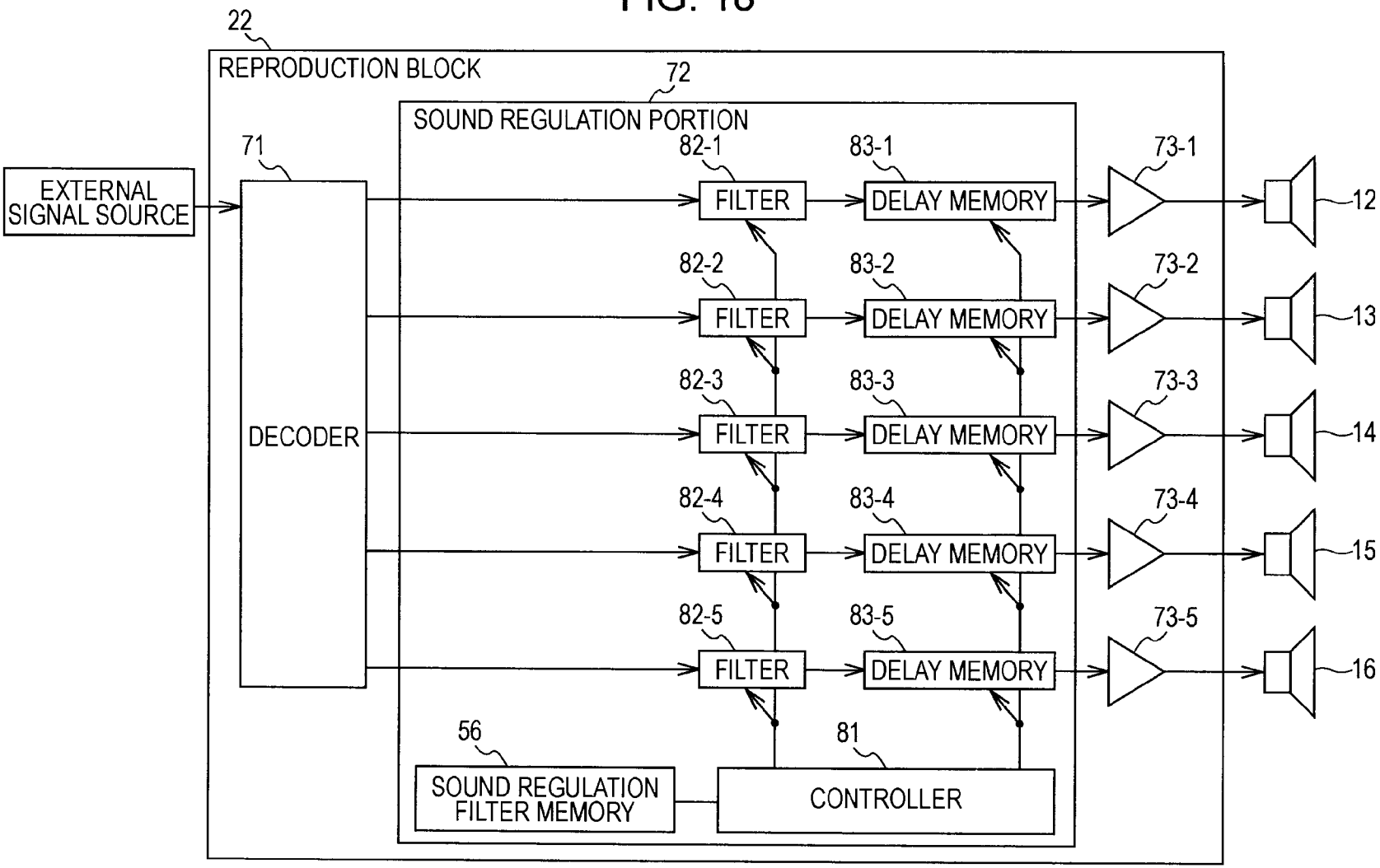
FIG. 18 is a block diagram showing a configuration example of a playback block.

FIG. 18 is a block diagram showing a configuration example of the playback block 22 of FIG. 1.

The playback block 22 of the example of FIG. 18 is configured so as to include a decoder 71, a sound adjustment portion 72, and amplifiers 73-1 to 73-5.

The sound signal is supplied from an external signal source, for example, such as a DVD playback device in the decoder 71. For example, a DVD playback device (not shown) reads the recording signal from an optical disc and supplies the signal to the decoder 71.

The decoder 71 decodes the supplied signal to an audio signal (a sound signal) of the multi channel (5.1ch), and outputs the sound signals of the respective decoded channels to the corresponding filters 82-1 to 82-5 in the sound adjustment portion 72. Furthermore, although it is not shown in FIG. 18, the decoder 71 also decodes and supplies the metadata or the like of the playback content to the controller 81.

The sound adjustment portion 72 includes the sound adjustment filter memory 56 of FIG. 2, the controller 81, the filters 82-1 to 82-5, and the delay memories 83-1 to 83-5. In the sound adjustment filter memory 56, a plurality of combinations of the filter coefficients interpreted and calculated by the interpretation block 21 of FIG. 2 is stored.

For example, the controller 81 reads the combination of the filter coefficients corresponding to the genre of the playback content from the sound adjustment filter memory 56 by referring to the information (the metadata) or the like which is added to the playback content to be supplied from the decoder 71. Moreover, the controller 81 supplies the same to the corresponding filters 82-1 to 82-5 of the respective channels. Furthermore, the controller 81 sets the suitable delay times corresponding to the respective channels to delay the memories 83-1 to 83-5, respectively.

That is, the coefficient sizes of the respective filters are not identical by the playback ability of the connected speaker, a desired (objective) sound adjustment amount, and a (genre of) reproduced content as mentioned in the description of the interpretation block 21. Thus, since a time difference occurs between the signals of the respective channels, in order to solve the time difference, a suitable delay time is calculated and is supplied to the delay memories 83-1 to 83-5, respectively.

The filter 82-1 performs the filter processing by the filter coefficient supplied from the controller 81 with respect to the sound signal of the center channel to be input from the decoder 71, and outputs the sound signal of the center channel after the filter processing to the delay memory 83-1. The filter 82-2 performs the filter processing by the filter coefficient supplied from the controller 81 with respect to the sound signal of the front L channel to be input from the decoder 71, and outputs the sound signal of the front L channel after the filter processing to the delay memory 83-2. The filter 82-3 performs the filter processing by the filter coefficient supplied from the controller 81 with respect to the sound signal of the front R channel to be input from the decoder 71, and outputs the sound signal of the front R channel after the filter processing to the delay memory 83-3.

The filter 82-4 performs the filter processing by the filter coefficient supplied from the controller 81 with respect to the sound signal of the surround L channel to be input from the decoder 71, and outputs the sound signal of the surround L channel after the filter processing to the delay memory 83-4. The filter 82-5 performs the filter processing by the filter coefficient supplied from the controller 81 with respect to the sound signal of the surround R channel to be input from the decoder 71, and outputs the sound signal of the surround R channel after the filter processing to the delay memory 83-5.

The delay memory 83-1 delays the sound signal of the center channel from the filter 82-1 by a delay time period from the controller 81 and outputs the sound signal of the delayed center channel to the amplifier 73-1. The delay memory 83-2 delays the sound signal of the front L channel from the filter 82-2 by a delay time period from the controller 81 and outputs the sound signal of the delayed front L channel to the amplifier 73-2. The delay memory 83-3 delays the sound signal of the front R channel from the filter 82-3 by a delay time period from the controller 81 and outputs the sound signal of the delayed front R channel to the amplifier 73-3.

The delay memory 83-4 delays the sound signal of the surround L channel from the filter 82-4 by a delay time period from the controller 81 and outputs the sound signal of the delayed surround L channel to the amplifier 73-4. The delay memory 83-5 delays the sound signal of the surround R channel from the filter 82-5 by a delay time period from the controller 81 and outputs the sound signal of the delayed surround R channel to the amplifier 73-5.

The amplifier 73-1 amplifies and outputs the sound signal of the center channel from the delay memory 83-1 to the center speaker 12. The amplifier 73-2 amplifies and outputs the sound signal of the front L channel from the delay memory 83-2 to the front L speaker 13. The amplifier 73-3 amplifies and outputs the sound signal of the front R channel from the delay memory 83-3 to the front R speaker 14.

The amplifier 73-4 amplifies and outputs the sound signal of the surround L channel from the delay memory 83-4 to the surround L speaker 15. The amplifier 73-5 amplifies and outputs the sound signal of the surround R channel from the delay memory 83-5 to the surround R speaker 16.

Explanation of Playback Processing

Figure 19:
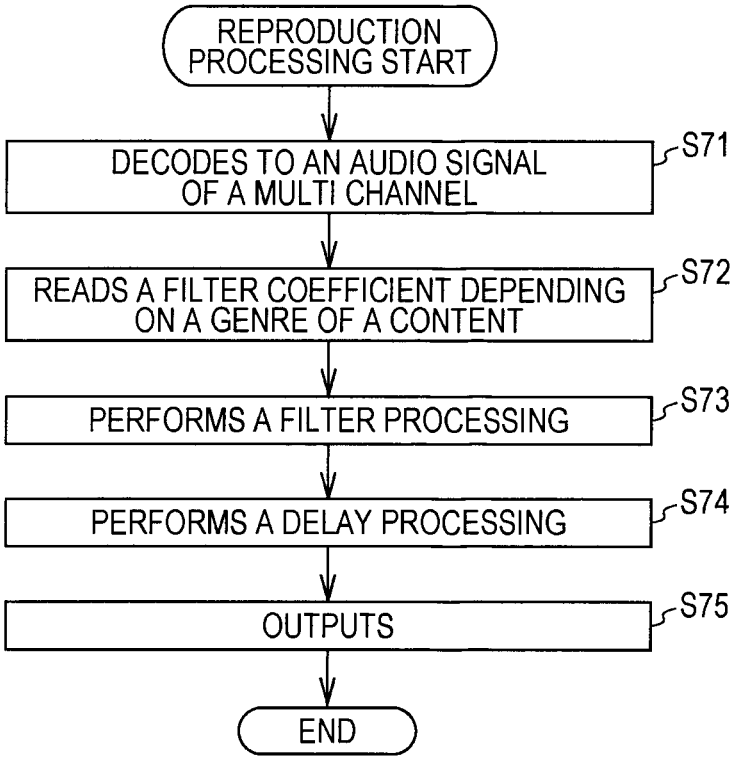
FIG. 19 is a flow chart that explains a playback processing of a playback block.

Next, a playback processing of a playback block 22 of FIG. 18 will be described with reference to the flow chart of FIG. 19.

The sound signal is supplied from an external signal source, for example, such as a DVD playback device to the decoder 71. In step S71, the decoder 71 decodes the supplied signal to an audio signal (a sound signal) of the multi-channel (5.1ch) and outputs the sound signal of the respective decoded channels to the corresponding filters 82-1 to 82-5 in the sound adjustment portion 72.

Furthermore, for example, the decoder 71 supplies the metadata or the like of the playback content to the controller 81.

In step S72, for example, the controller 81 reads the combination of the filter coefficients corresponding to the genre of the playback content from the sound adjustment filter memory 56, by referring to the information (the metadata) or the like added to the playback content to be supplied from the decoder 71. Moreover, the controller 81 supplies the respective filter coefficients to the corresponding filters 82-1 to 82-5, calculates the delay time corresponding to the respective channels, and supplies the delay memories 83-1 to 83-5.

In step S73, the filters 82-1 to 82-5 perform the filter processing by the respective filter coefficients supplied from the controller 81 with respect to the sound signals of the respective channels to be input from the decoder 71, respectively. Moreover, the filters 82-1 to 82-5 output the sound signals of the respective channels after the filter processing to the delay memories 83-1 to 83-5.

In step S74, the delay memories 83-1 to 83-5 perform the delay processing at the respective delay times supplied from the controller 81 with respect to the sound signals of the respective channels to be input from the filters 82-1 to 82-5, respectively. Moreover, the delay memories 83-1 to 83-5 output the sound signals of the respective channels after the delay processing to the amplifiers 73-1 to 73-5, respectively.

In step S75, the respective speakers 12 to 16 output the sounds corresponding to the sound signals from the corresponding amplifiers 73-1 to 73-5, respectively.

That is, the center speaker 12 outputs the sounds corresponding to the sound signals of the center channel amplified by the amplifier 73-1. The front L speaker 13 outputs the sound corresponding to the sound signal of the front L channel amplified by the amplifier 73-2. The front R speaker 14 outputs the sound corresponding to the sound signal of the front R channel amplified by the amplifier 73-3.

The surround L speaker 15 outputs the sound corresponding to the sound signal of the surround L channel amplified by the amplifier 73-4. The surround R speaker 16 outputs the sound corresponding to the sound signal of the surround R channel amplified by the amplifier 73-5.

As described above, the filter processing is performed by the filter coefficients corresponding to the respective channels, the sound corresponding to the sound signal performed to the delay processing at the delay time corresponding to the respective channels is output.

As a result, it is possible to perform an effective and efficient sound adjustment under the limited calculation resources, and thus a suitable surround effect can be obtained.

Furthermore, since the filter coefficient corresponding to the playback content is read and used, it is possible to allocate many more filter coefficients to the channel which has a high playback frequency, that is, becomes important under the limited calculation resources.

As a result, a sound adjustment optimal for the playback content is possible, and thus a suitable surround effect can be obtained.

In addition, in the aforementioned description, as shown in FIG. 17, although an example was explained in which the preset fixed weighting value is used corresponding to the genre of the playback content, by interpreting the playback frequency of the actually reproduced signal, the more realistic weighting value can be used.

Another Configuration Example of Playback Block

Figure 20:
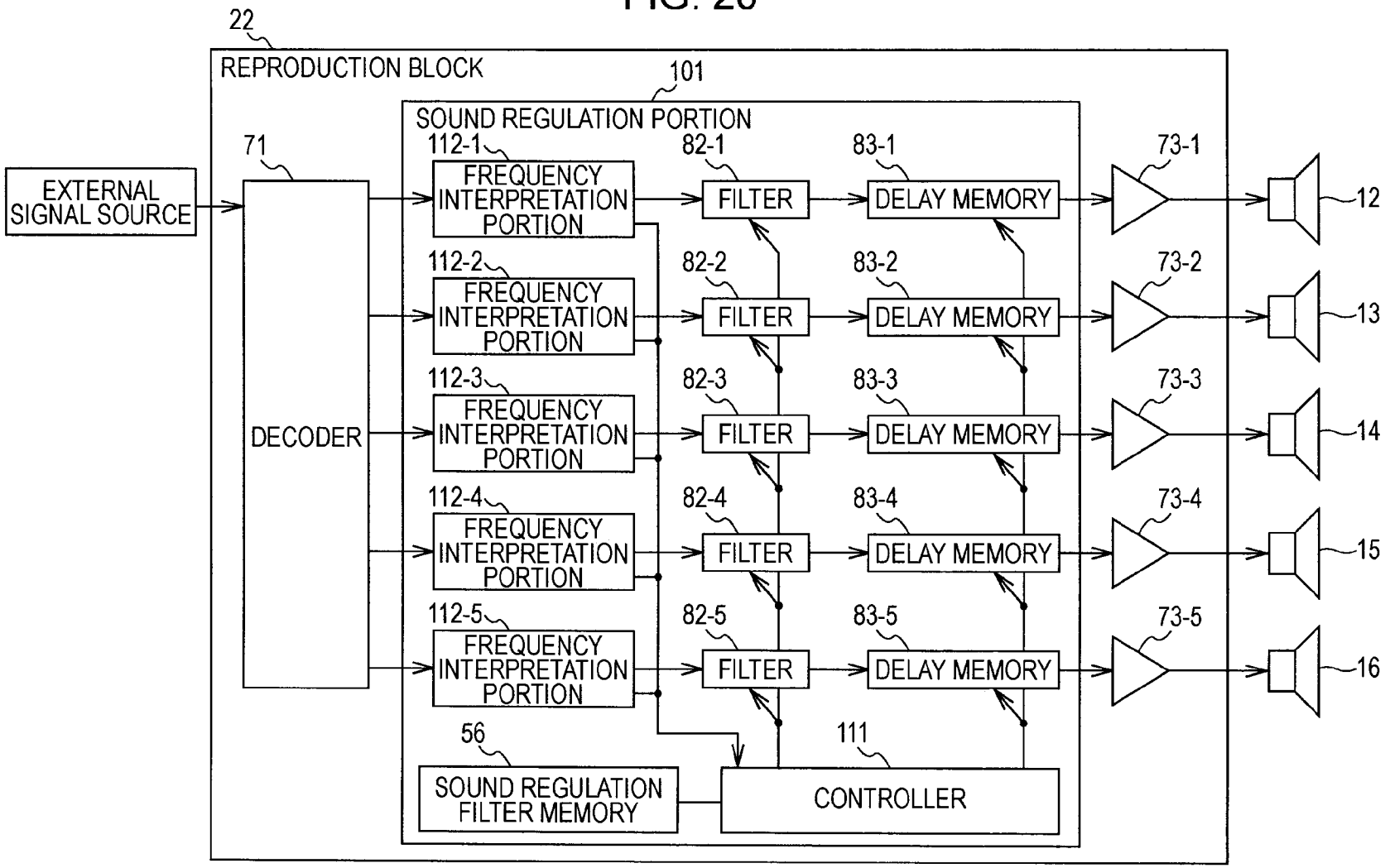
FIG. 20 is a block diagram showing another configuration example of a playback block.

FIG. 20 is a block diagram that shows a configuration example of the playback block 22 performing the playback frequency interpretation.

The playback block 22 of FIG. 20 is different from the playback block 22 of FIG. 18 in that the sound adjustment portion 72 is replaced by a sound adjustment portion 101. The playback block 22 of FIG. 20 is common to the playback block 22 of FIG. 18 in that it includes a decoder 71 and amplifiers 73-1 to 73-5.

Furthermore, the sound adjustment portion 101 is different from the sound adjustment portion 72 of FIG. 18 in that the controller 81 is replaced by a controller 111 and frequency interpretation portions 112-1 to 112-5 are added. The sound adjustment portion 101 is common to the sound adjustment portion 72 of FIG. 18 in that it includes the sound adjustment filter memory 56 of FIG. 2, the filters 82-1 to 82-5, and the delay memories 83-1 to 83-5.

The decoder 71 outputs the decoded sound signals of the respective channels to the corresponding frequency interpretation portions 112-1 to 112-5 in the sound adjustment portion 101.

The frequency interpretation portion 112-1 outputs the sound signal of the center channel, which was input from the decoder 71, to the filter 82-1 as it is, and interprets the playback frequency of the sound signal of the center channel. Moreover, the frequency interpretation portion 112-1 supplies the playback time per a means time of the center channel, which is the interpretation result, to the controller 111.

The frequency interpretation portion 112-2 outputs the sound signal of the front L channel, which was input from the decoder 71, to the filter 82-2 as it is, and interprets the playback frequency of the sound signal of the front L channel. Moreover, the frequency interpretation portion 112-2 supplies the playback time per a means time of the front L channel, which is the interpretation result, to the controller 111.

The frequency interpretation portion 112-3 outputs the sound signal of the front R channel, which was input from the decoder 71, to the filter 82-3 as it is, and interprets the playback frequency of the sound signal of the front R channel. Moreover, the frequency interpretation portion 112-3 supplies the playback time per a means time of the front R channel, which is the interpretation result, to the controller 111.

The frequency interpretation portion 112-4 outputs the sound signal of the surround L channel, which is input from the decoder 71, to the filter 82-4 as it is, and interprets the playback frequency of the sound signal of the surround L channel. Moreover, the frequency interpretation portion 112-4 supplies the playback time per a means time of the surround L channel, which is the interpretation result, to the controller 111.

The frequency interpretation portion 112-5 outputs the sound signal of the surround R channel, which was input from the decoder 71, to the filter 82-5 as it is, and interprets the playback frequency of the sound signal of the surround R channel. Moreover, the frequency interpretation portion 112-5 supplies the playback time per a means time of the surround R channel, which is the interpretation result, to the controller 111.

The controller 111 obtains the weighting values of the respective channels based on the playback time per the means time of the respective channels. Furthermore, in the sound adjustment filter memory 56, the coefficient allocation evaluation value calculated in the prior interpretation processing is stored. The controller 111 reads the coefficient allocation evaluation value from the sound adjustment filter memory 56, calculates the filter coefficients corresponding to the respective channels, and supplies the respective calculated filter coefficients to the corresponding filters 82-1 to 82-5 of the respective channels. Furthermore, the controller 81 sets the suitable delay times corresponding to the respective channels to the delay memories 83-1 to 83-5, respectively.

In addition, hereinafter, when there is no necessity to individually distinguish the filters 82-1 to 82-5, the filters are referred to as a filter 82. Furthermore, when there is no necessity to individually distinguish the frequency interpretation portions 112-1 to 112-5, the frequency interpretation portion is referred to as a frequency interpretation portion 112.

Configuration Example of Frequency Interpretation Portion

Figure 21:
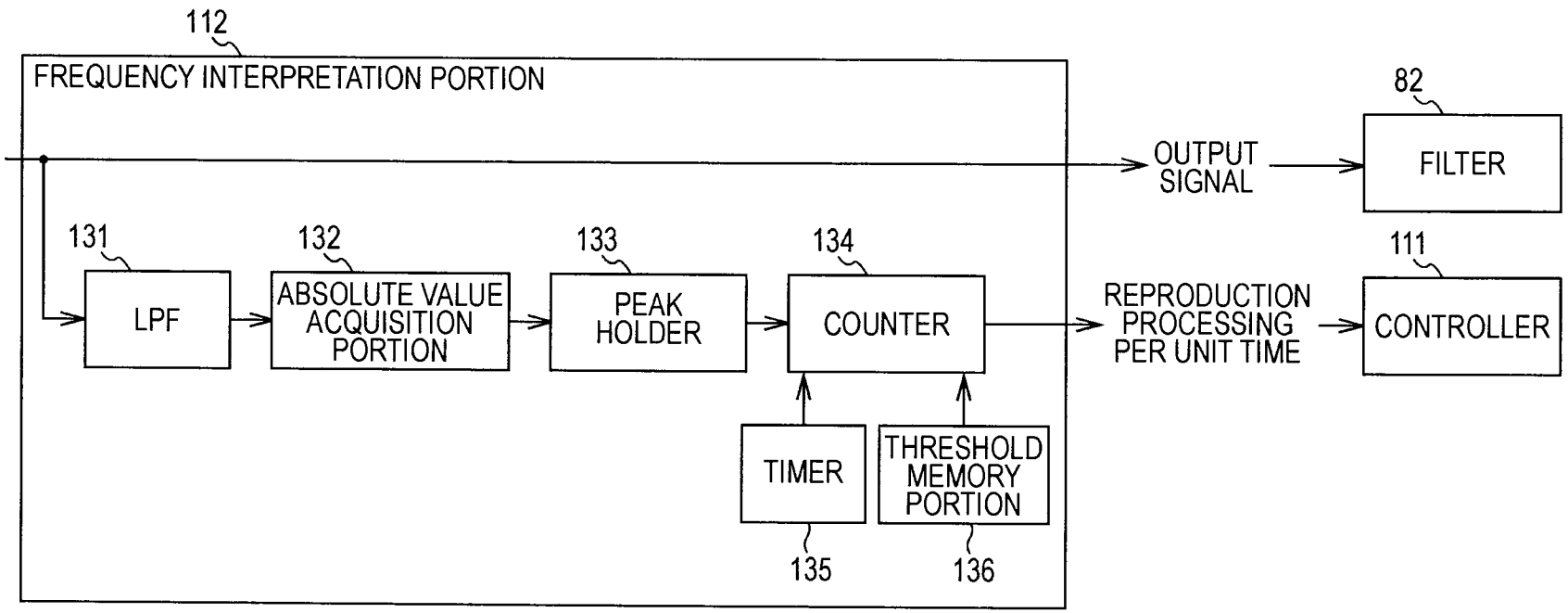
FIG. 21 is a block diagram showing a configuration example of a frequency interpretation portion.

FIG. 21 is a block diagram that shows a configuration example of the frequency interpretation portion 112.

The frequency interpretation portion 112 includes an LPF (low pass filter) 131, an absolute value acquisition portion 132, a pick holder 133, a counter 134, a timer 135, and a threshold value memory portion 136.

The sound signal from the decoder 71 to be input to the frequency interpretation portion 112 is output to the corresponding filter 82 as it is, and is input to the LPF 131. The LPF 131 extracts the low zone components from the input sound signal and outputs the extracted low zone components to the absolute value acquisition portion 132.

The absolute value acquisition portion 132 takes the absolute value of the signal of the low zone component from LPF 131 and outputs the same to the pick holder 133. The pick holder 133 has a certain time constant number, obtains an envelope of a signal waveform from the signal of the absolute value acquisition portion 132, and outputs the value of the obtained envelope to the counter 134.

The counter 134 reads the set threshold value from the threshold value memory portion 136, compares the threshold value with the value of the envelope from the pick holder 133, and measures (counts) the time when the value of the envelope exceeds the threshold value. Furthermore, since the timer signal is supplied from the timer 135 to the counter 134, it is possible to obtain a playback time Ji of the low zone component per a means time, for example, in the i channel. The counter 134 supplies the obtained playback time Ji per the means time to the controller 111.

Explanation of Playback Processing

Next, a playback processing of the playback block 22 of FIG. 20 will be described with reference to the flow chart of FIG. 22.

For example, the sound signal is supplied from an external signal source such as a DVD playback device to the decoder 71. In step S111, the decoder 71 decodes the supplied signal to an audio signal (a sound signal) of the multi channel (5.1ch) and the decoded sound signals of the respective channels to the corresponding frequency interpretation portions 112-1 to 112-5 in the sound adjustment portion 72.

In step S112, the frequency interpretation portions 112-1 to 112-5 interpret the input sound signal of the corresponding channel, and the controller 111 calculates the weighting values of the respective channels based on the interpretation result.

That is, the sound signal from the decoder 71 to be input to the frequency interpretation portion 112 is output to the corresponding filter 82 as it is, and is input to the LPF 131. The LPF 131 extracts the low zone component from the input sound signal and outputs the extracted low zone component to the absolute value acquisition portion 132.

The absolute value acquisition portion 132 takes the absolute value of the signal of the low zone component from the LPF 131 and outputs the same to the peak holder 133. The peak holder 133 has a certain time constant number, obtains the envelope of the signal waveform from the signal of the absolute value from the absolute value acquisition portion 132, and outputs the value of the obtained value of the envelope to the counter 134.

The counter 134 reads the preset threshold value from the threshold value memory portion 136, compares the threshold value with the value of the envelope from the pick holder 133, and measures (counts) the time when the value of the envelope exceeds the threshold value. Furthermore, since the timer signal is supplied from the timer 135 to the counter 134, it is possible to obtain a playback time Ji of the low zone component per a means time, for example, in the i channel. The counter 134 supplies the obtained playback time Ji per the means time to the controller 111.

The controller 111 obtains the value M in which the playback time Ji per the means time of the respective channels from the respective frequency interpretation portions 112 are added all over the channels, and obtains the weighting values Ui of the respective channels by the following equation (3): The weighting value corresponds to the weighting value corresponding to the content described with reference to FIG. 17.

$$Ui=Ji/M \quad (3)$$

In step S113, the controller 111 reads the coefficient allocation evaluation value stored in the prior interpretation processing from the sound adjustment filter memory 56. The coefficient allocation evaluation value is a coefficient allocation evaluation value calculated in step S17 of FIG. 4 and, in this example, the coefficient allocation evaluation value is stored in the sound adjustment filter memory 56 after being calculated.

In step S114, the controller 111 multiplies the read coefficient allocation evaluation value by the obtained weighting values of the respective channels, and calculates the filter coefficients of the respective channels based on the coefficient allocation evaluation value multiplied by the weighting value. Since the calculation processing of the filter coefficient in step S114 is basically the same as the filter coefficient calculation processing in step S19 of FIG. 4, the description thereof will be omitted.

The controller 111 supplies the corresponding filters 82-1 to 82-5 with the respective filter coefficients, calculates the delay times corresponding to the respective channels, and supplies the delay memories 83-1 to 83-5.

In step S115, the filters 82-1 to 82-5 perform the filter processing by the respective filter coefficients supplied from the controller 81, with respect to the sound signals of the respective channels to be input from the decoder 71, respectively. Moreover, the filters 82-1 to 82-5 output the sound signals of the respective channels after the filter processing to the delay memories 83-1 to 83-5.

In step S116, the delay memories 83-1 to 83-5 perform the delay processing at the respective delay times supplied from the controller 81, with respect to the sound signals of the respective channels to be input from the filters 82-1 to 82-5, respectively. Moreover, the delay memories 83-1 to 83-5 output the sound signals of the respective channels after the delay processing to the amplifiers 73-1 to 73-5, respectively.

In step S117, the respective speakers 12 to 16 output the sound corresponding to the sound signal from the corresponding amplifiers 73-1 to 73-5, respectively.

That is, the center speaker 12 outputs the sound corresponding to the sound signal of the center channel amplified by the amplifier 73-1. The front L speaker 13 outputs the sound corresponding to the sound signal of the front L channel amplified by the amplifier 73-2. The front R speaker 14 outputs the sound corresponding to the sound signal of the front R channel amplified by the amplifier 73-3.

The surround L speaker 15 outputs the sound corresponding to the sound signal of the surround L channel amplified by the amplifier 73-4. The surround R speaker 16 outputs the sound corresponding to the sound signal of the surround R channel amplified by the amplifier 73-5.

As described above, the playback frequencies of the respective channels of the contents during playback are interpreted, the filter processing is performed by the filter coefficients corresponding to the playback frequencies, and the sound corresponding to the sound signal subjected to the delay processing at the delay time corresponding to the respective channels is output.

As a result, it is possible to perform an effective and efficient sound adjustment under the limited calculation resources, and thus a suitable surround effect can be obtained in the content during playback.

In addition, in the above-mentioned description, the description has been given of a case where the filter coefficient calculated from the interpretation result of the content during playback is directly used to perform the filter processing, but if the filter coefficient is directly used, the sound effect is changed during the playback of the content. Thus, at a gap of the content, that is, until the next content is reproduced, the filter processing may be performed by the filter coefficient used hitherto, and the filter coefficient may be changed at a gap of the content playback. Otherwise, the playback frequencies of the respective channels may be stored in advance, and when the playback frequency is greatly changed, the filter coefficient may be changed.

Figure 4:
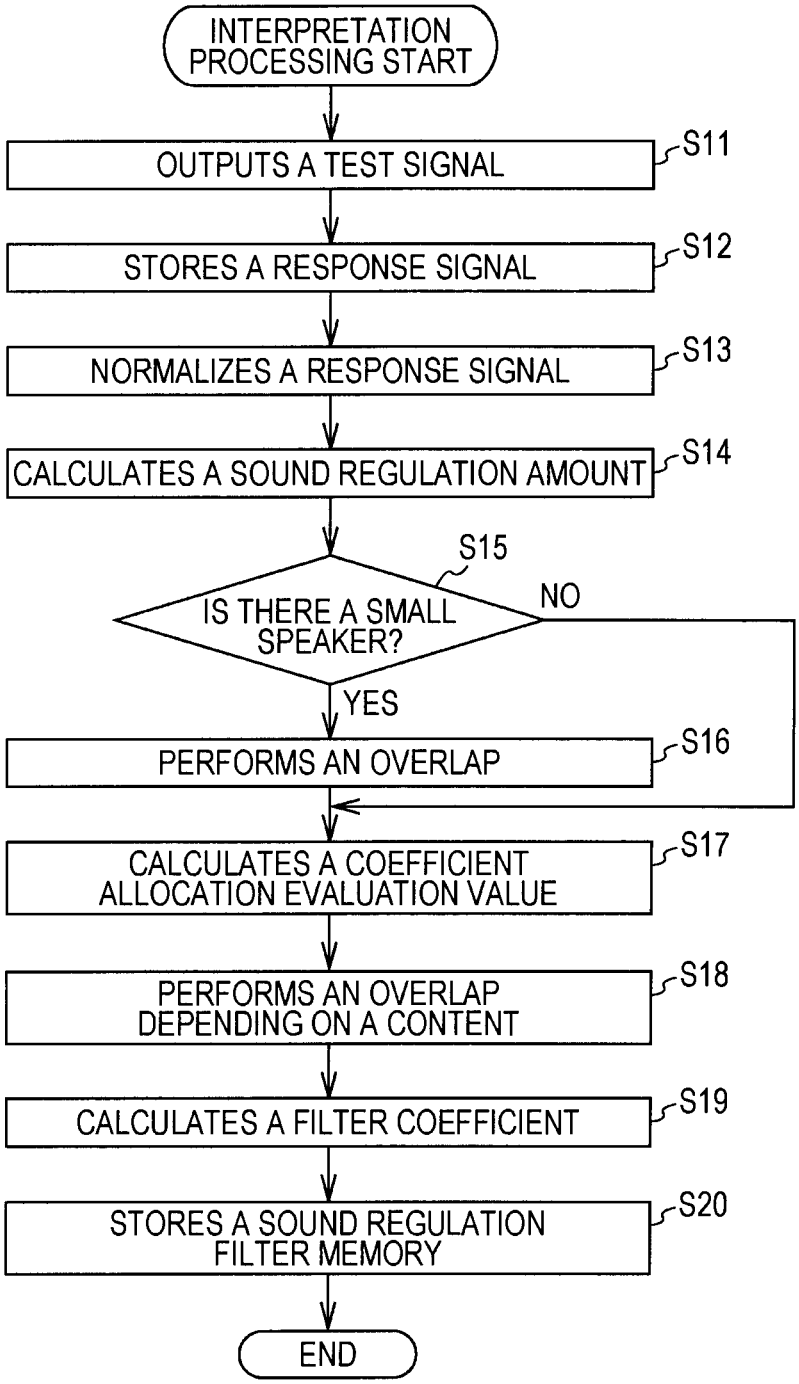
FIG. 4 is a flow chart that explains an interpretation processing of an interpretation block.
Figure 22:
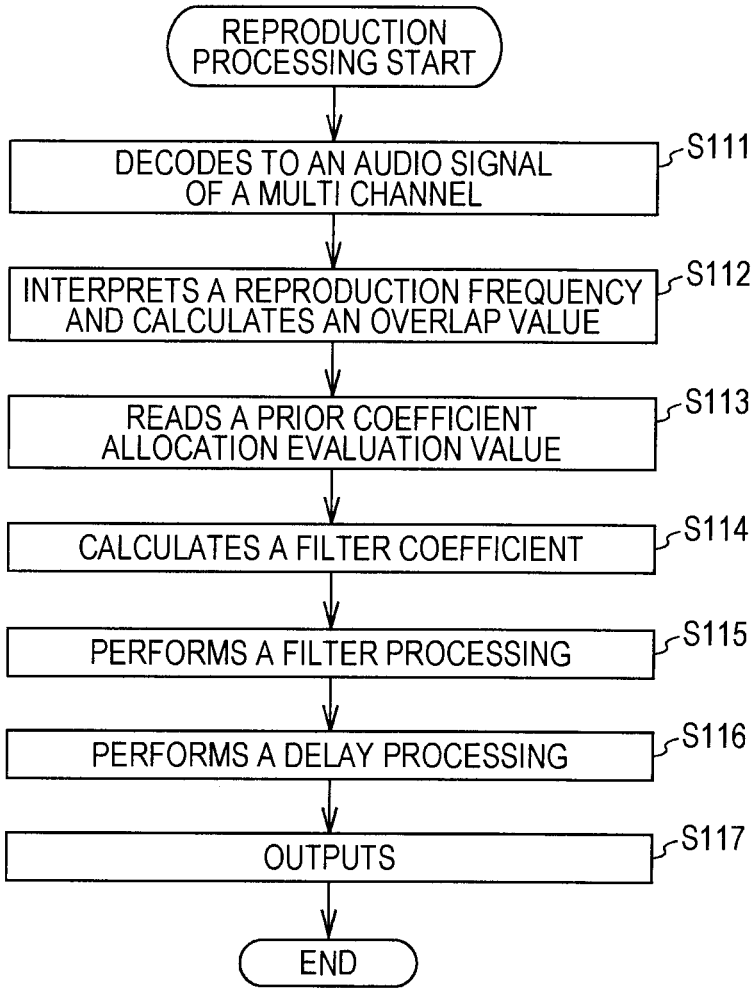
FIG. 22 is a flow chart that explains a playback processing of a playback block of FIG. 20.

Furthermore, an example was described where the filter coefficient is calculated from the interpretation result of the content during playback, but the weighting value obtained in step S112 of FIG. 22 may be stored in the sound adjustment filter memory 56 or the like and may be used in step S18 of the next interpretation processing of FIG. 4.

In addition, in the above-mentioned description, an example of the multi channel of 5.1ch was described, but the channel may be 7ch or 9ch without being limited to 5ch, and the invention can be applied to a plurality of channels of two or more.

The above-mentioned series processing can be carried out by hardware and can be carried out by a software. In the case of carrying out the series of processing by a software, a program constituting the software is installed in a computer. Herein, the computer includes a computer, which is built in dedicated hardware, and a general-purpose computer or the like which can carry out various functions by installing various programs.

Configuration Example of Personal Computer

Figure 23:
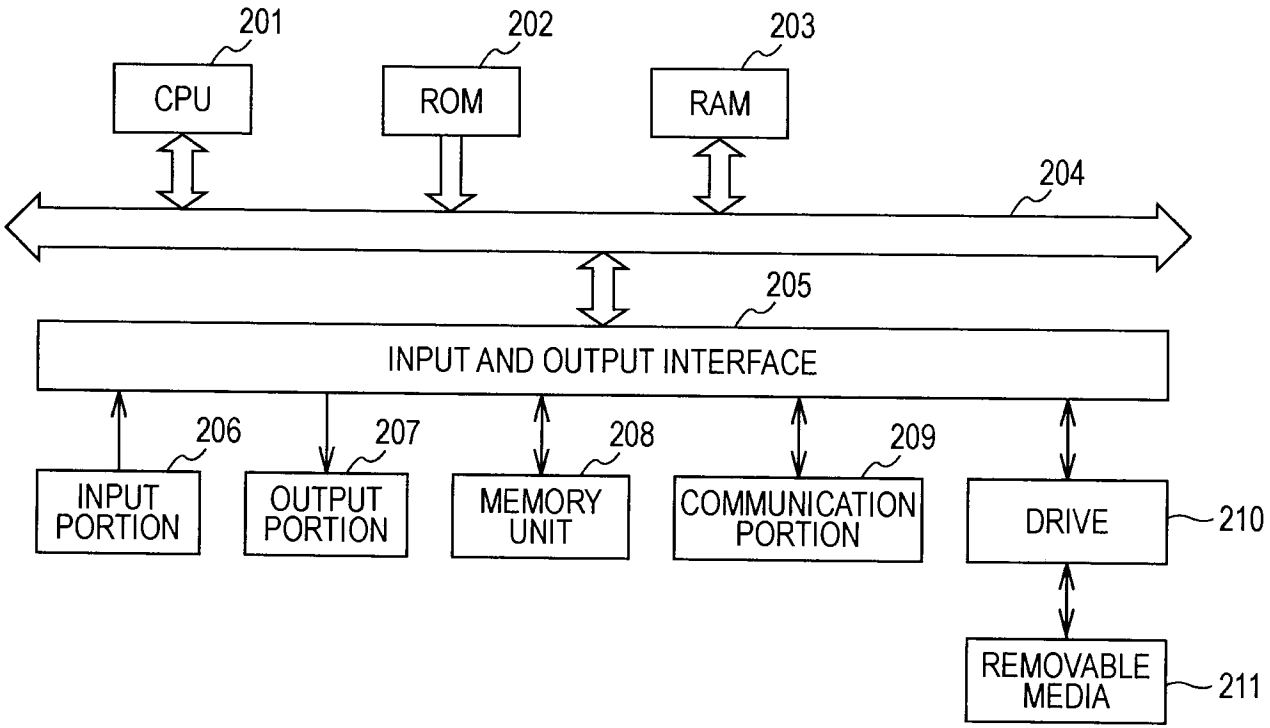
FIG. 23 is a block diagram showing a configuration example of hardware of a computer.

FIG. 23 is a block diagram that shows a configuration example of hardware of a computer which carries out the above-mentioned series processing by a program.

In the computer, a CPU (Central Processing Unit) 201, a ROM (Read Only Memory) 202, and a RAM (Random Access Memory) 203 are connected to each other by a bus 204.

Furthermore, an input and output interface 205 is connected to the bus 204. An input portion 206, an output portion 207, a memory portion 208, a communication portion 209, and a drive 210 are connected to the input and output interface 205.

The input portion 206 includes a keyboard, a mouse, a microphone, or the like. The output portion 207 includes a display, a speaker, or the like. The memory portion 208 includes a hard disk, a nonvolatile memory, or the like. The communication portion 209 includes a network interface or the like. The drive 210 drives removable media 211 such as a magnetic disc, an optical disc, an optical magnetic disc, or a semiconductor memory.

In the computer configured in this manner, for example, the CPU 201 loads and executes the program stored in the memory portion 208 to the RAM 203 via the input and output interface 205 and the bus 204, whereby the above-mentioned series of processing is performed.

The program executed by the computer (CPU 201) can be, for example, recorded and provided on the removable media 211 as a package media and the like. Furthermore, the program can be provided via a wire or a wireless transmission medium such as a local area network, the Internet, or a digital broadcast.

In the computer, the program can be installed in the memory portion 208 via the input and output interface 205 by mounting the removable media 211 on the drive 210. Furthermore, the program can be received by the communication portion 209 via the wire or wireless transmission medium and can be installed in the memory portion 208. In addition, the program can be installed in the ROM 202 or the memory portion 208 in advance.

In addition, the program executed by the computer may be a program which performs the processing in time series according to a sequence described in the specification, and may be a program which performs the processing in parallel or at a necessary timing such as upon being called out.

The embodiment of the invention is not limited to the above-mentioned embodiment but can be variously changed within a scope of not departing from the gist of the invention.

The present application contains subject matter related to that disclosed in Japanese Priority Patent Application JP 2010-083599 filed in the Japan Patent Office on Mar. 31, 2010, the entire contents of which are hereby incorporated by reference.

It should be understood by those skilled in the art that various modifications, combinations, sub-combinations and alterations may occur depending on design requirements and other factors insofar as they are within the scope of the appended claims or the equivalents thereof.

What is claimed is:

1. A signal processing device comprising:

sound adjustment amount calculation means which calculates a sound adjustment amount for adjusting sound characteristics of each channel to a predetermined sound characteristic for each channel, using a sound signal that is obtained by collecting the outputs of each channel;

evaluation value calculation means which calculates a coefficient allocation evaluation value for allocating a size of a filter coefficient necessary for the sound adjustment of the respective channels for each channel, based on the sound adjustment amount that is calculated by the sound adjustment amount calculation means; and filter coefficient calculation means which calculates the filter coefficient for each channel using the coefficient allocation evaluation value that is calculated by the evaluation value calculation means.

2. The signal processing device according to claim 1, wherein the evaluation value calculation means calculates the coefficient allocation evaluation value for each channel by multiplying the calculated coefficient allocation evaluation value by a weighting value corresponding to the content becoming a playback target.

3. The signal processing device according to claim 2, wherein the weighting value corresponding to the content is set for each channel corresponding to the content in advance.

4. The signal processing device according to claim 2, further comprising:

frequency interpretation means which interprets the playback frequencies of the respective channels at the time of the playback of the content, wherein the weighting value corresponding to the content is calculated for each channel on the basis of the playback frequency that is interpreted by the frequency interpretation means.

5. The signal processing device according to claim 2, wherein, in the case of being decided as a small speaker from a ratio of an area of a low zone and a high zone of the sound signal, the sound adjustment amount calculation means calculates the sound adjustment amount for each channel by multiplying the calculated sound adjustment amount by a weighting coefficient in which the low zone is limited.

6. The signal processing device according to claim 1, further comprising:

a filter processing means which performs a filter processing of the sound signal of the content during playback for each channel using the filter coefficient that is calculated by the filter coefficient calculation means; and a delay means which performs a delay processing of the sound signal subjected to the filter processing by the filter processing means for each channel.

7. The signal processing device according to claim 1, wherein the channel includes five channels or more.

8. A signal processing method of a signal processing device including sound adjustment amount calculation means, evaluation value calculation means, and filter coefficient calculation means, the method of comprising the steps of:

allowing the sound adjustment amount calculation means to calculate a sound adjustment amount for adjusting sound characteristics of each channel to a predetermined sound characteristic for each channel, using a sound signal that is obtained by collecting the outputs of each channel, allowing the evaluation value calculation means to calculate a coefficient allocation evaluation value for allocating a size of a filter coefficient necessary for the sound adjustment of the respective channels for each channel, based on the calculated sound adjustment amount, and allowing the filter coefficient calculation means to calculate the filter coefficient for each channel using the calculated coefficient allocation evaluation value.

9. A non-transitory computer readable storage medium storing a program, executable by a processor, for causing a computer to function as:

sound adjustment amount calculation means which calculates a sound adjustment amount for adjusting sound characteristics of each channel to a predetermined sound characteristic for each channel, using a sound signal that is obtained by collecting the outputs of each channel;

evaluation value calculation means which calculates a coefficient allocation evaluation value for allocating a size of a filter coefficient necessary for the sound adjustment of the respective channels for each channel, based on the sound adjustment amount that is calculated by the sound adjustment amount calculation means; and filter coefficient calculation means which calculates the filter coefficient for each channel using the coefficient allocation evaluation value that is calculated by the evaluation value calculation means.

10. A signal processing device comprising:

a sound adjustment amount calculation unit which calculates a sound adjustment amount for adjusting sound characteristics of each channel to a predetermined sound characteristic for each channel, using a sound signal that is obtained by collecting the outputs of each channel;

an evaluation value calculation unit which calculates a coefficient allocation evaluation value for allocating a size of a filter coefficient necessary for the sound adjustment of the respective channels for each channel, based on the sound adjustment amount that is calculated by the sound adjustment amount calculation unit; and a filter coefficient calculation unit which calculates the filter coefficient for each channel using the coefficient allocation evaluation value that is calculated by the evaluation value calculation unit.

* * * * *